US005431081A

United States Patent [19]

Lombardi et al.

[11] Patent Number: 5,431,081

[45] Date of Patent: Jul. 11, 1995

[54] DRUM BEATER PEDAL BEARING AND APPARATUS

[75] Inventors: Donald G. Lombardi, Thousand Oaks; Christopher Orberg, Sacramento, both of Calif.

[73] Assignee: Drum Workshop, Inc., Oxnard, Calif.

[21] Appl. No.: 242,870

[22] Filed: May 16, 1994

Related U.S. Application Data

[63] Continuation-in-part of Ser. No. 190,499, Feb. 2, 1994, which is a continuation-in-part of Ser. No. 35,065, Mar. 22, 1993, Pat. No. 5,361,670, which is a continuation of Ser. No. 783,864, Oct. 28, 1991, Pat. No. 5,204,485.

[51] Int. Cl.[6] ..... G10D 13/00

[52] U.S. Cl. ..... 84/422.1

[58] Field of Search ..... 84/422.1–422.4

[56] References Cited

U.S. PATENT DOCUMENTS 3,618,441 11/1971 Fearns .
3,742,806 7/1973 Zalmer .
3,968,718 7/1976 Carver .
4,188,853 2/1980 Bills .
4,538,499 9/1985 Livingston .
4,756,224 7/1988 Lombardi .
4,945,803 8/1990 Norwood .
5,204,485 4/1993 Lombardi .

FOREIGN PATENT DOCUMENTS 62-20179 2/1987 Japan .
644147 2/1989 Japan .

*Primary Examiner*—William M. Shoop, Jr.
*Assistant Examiner*—Jeffrey W. Donels
*Attorney, Agent, or Firm*—William W. Haefliger

[57] ABSTRACT

In a drum beater assembly, the combination comprising a first base; first shaft means and first pedestal means on the first base supporting the first shaft means for rotation; first beater means carried by the first shaft means; a pedal on the first base and operatively connected to the first shaft means, for rotating same; a heel plate on the first base; and a roller bearing pivot support on the base proximate the heel plate and supporting the pedal for pivoting forwardly of the heel plate.

29 Claims, 5 Drawing Sheets

3
22c
21c
22a
21a
22
21
22b
21b
56a
61
58a
16
16b
15
19
16c
18
14
58c
60
54
42
59
49
21d
58b
19c
12a
22d
16a
56
17
11
46
12
35
41
31
13
10
3

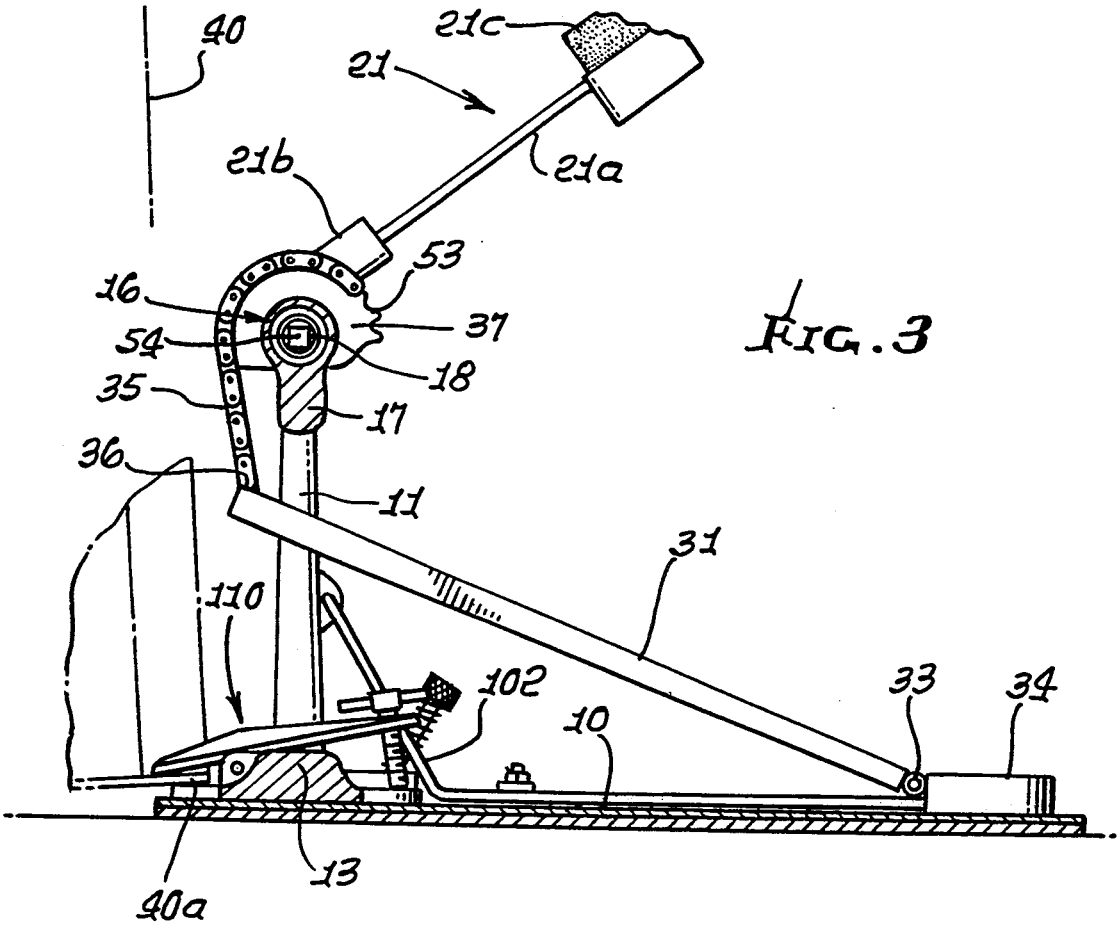
FIG. 3
FIG. 5.
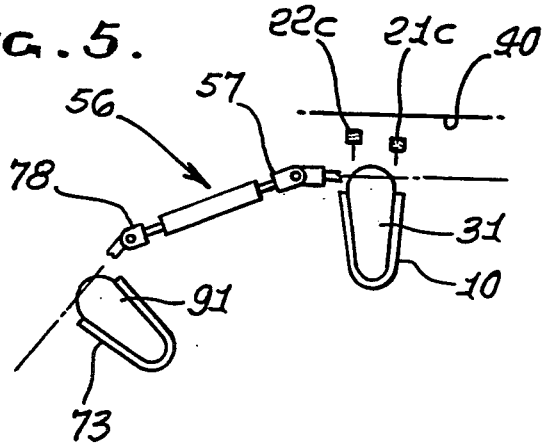

DRUM BEATER PEDAL BEARING AND APPARATUS

This application is a continuation-in-part of Ser. No. 08/190,499, filed Feb. 2, 1994, which is a continuation-in-part of Ser. No. 08/035,065 filed Mar. 22, 1993, now U.S. Pat. No. 5,361,670 issued Nov. 8, 1994, which is a continuation of Ser. No. 07/783,864 filed Oct. 28, 1991, now U.S. Pat. No. 5,204,485 issued Apr. 20, 1993.

BACKGROUND OF THE INVENTION

This invention relates generally to drum beating apparatus having one or more beaters, and more particularly concerns the operation and mounting of such beaters and pedal actuators for such beaters. There is need for trouble free mounting of pedals that operate drum beaters, such pedals being subject to pounding by drummer's shoes. Such need arises particularly in drum beating apparatus in which two beaters are located close to one another to strike the same drum surface, but wherein the two beaters are independently operable by foot pedals located at different, separate positions. No prior apparatus meets these objectives in the novel and unusually advantageous ways as now afforded by the present invention incorporating unusually advantageous structural combinations and modes of operation.

SUMMARY OF THE INVENTION

It is a major object of the invention to provide improved drum beating apparatus meeting the above as well as other needs and objectives. Basically, the invention is embodied in a combination that includes:

a) a first base, b) first shaft means and first pedestal means on the first base supporting the first shaft means for rotation, c) first beater means carried by the first shaft means, d) a pedal on the first base and operatively connected to the first shaft means, for rotating same, e) a heel plate on the first base, f) and a roller bearing pivot support on the base proximate said heel plate and supporting the pedal for pivoting forwardly of the heel plate.

Another object is to provide improved application that includes:

a) a first frame including first pedestal b) first, second and third bearings carried by the first pedestal means, in spaced coaxial relation, c) a primary axle carried by the first and third bearings, and a primary drum beater carried by the primary axle, d) a secondary axle carried by the second and third bearings, and a secondary drum beater carried by the secondary axle, e) the primary and secondary axles being independently rotatable, there being a first pedal operatively connected to the primary axle to rotate the primary axle and primary drum beater in response to pedal pivoting, f) and a first base plate integrally supporting the first pedestal means, the first plate also supporting the first pedal for pivoting relative thereto, g) there being auxiliary means operatively connected to the secondary axle to rotate the secondary axle and secondary drum beater, the auxiliary means including a tertiary axle and a single pedestal which is the only pedestal supporting the tertiary axle for rotation, and a second pedal operable to rotate the tertiary axle, h) means supporting the single pedestal and the second pedal, i) a heel support on the first plate, and a roller bearing pivot support on the first plate supporting the first pedal for pivoting relative to the heel support and said first plate.

Another object is to provide laterally spaced pillow blocks integral with the first plate, the roller bearing pivot support located between and carried by the pillow and blocks. As will be seen the roller bearing pivot support includes laterally extending trunnion means supported by roller bearings in said pillow blocks, and structure carried by said bearings and attached to said pedal via a tab integral with the shaft means and projecting therefrom. When a second base plate is used, with pedal thereon, it may also incorporate the same or similar roller bearing pivot support elements.

These and other objects and advantages of the invention, as well as the details of an illustrative embodiment, will be more fully understood from the following specification and drawings, in which:

DRAWING DESCRIPTION

FIG. 3 is a section taken on lines 3—3 of FIG. 2;

FIG. 5 is a diagrammatic view showing relative adjustability of two pedals on two base plates, in association with two drum beaters which have fixed relative positions;

DETAILED DESCRIPTION

Figure 1:
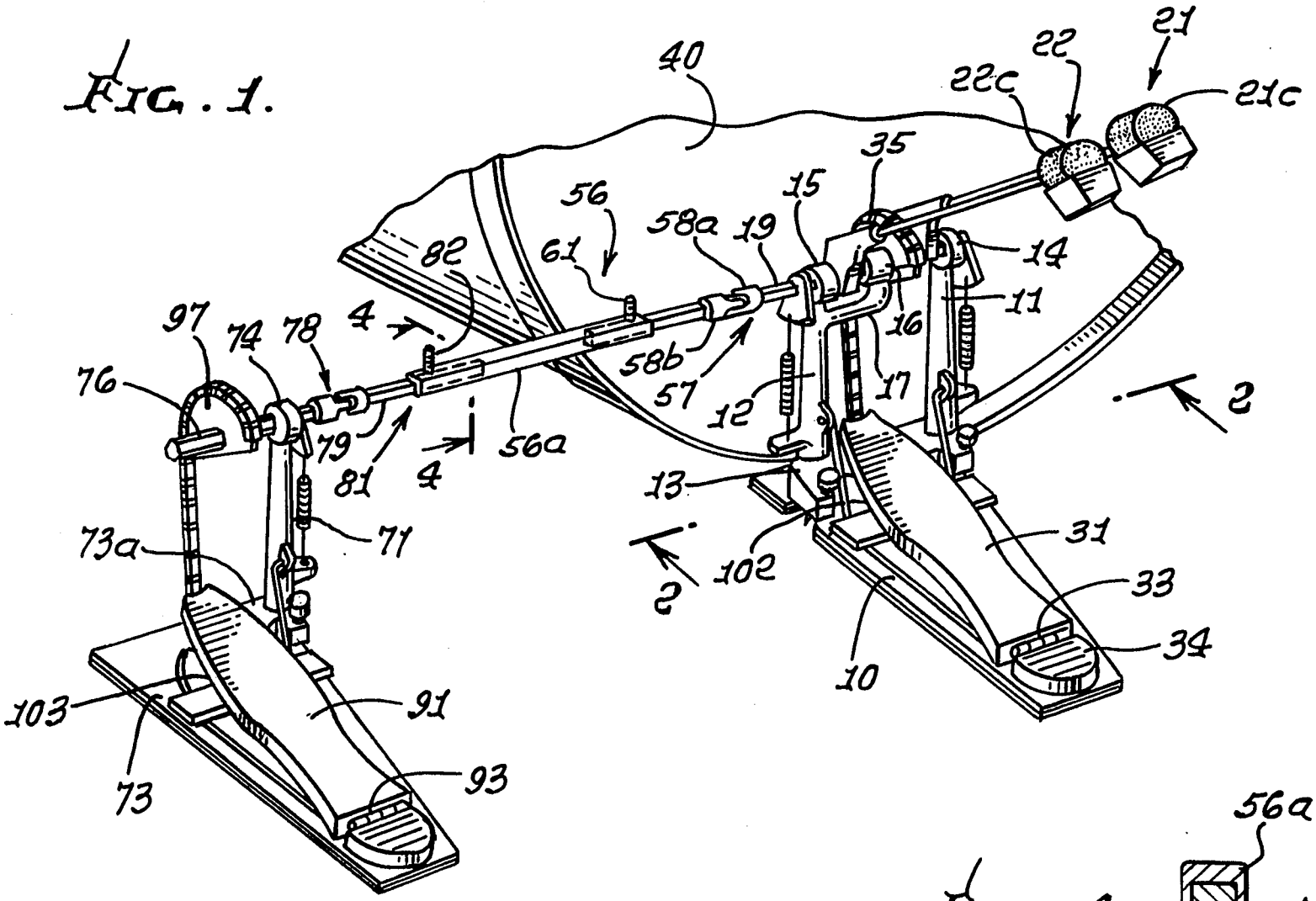
FIG. 1 is a perspective view of the apparatus incorporating the invention.
Figure 4:
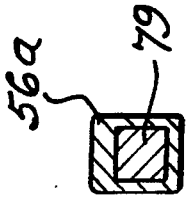
FIG. 4 is a section taken on lines 4—4 of FIG. 1.

In the drawings, a first horizontal, longitudinally extending base plate 10 integrally supports a first frame that includes first pedestal means. Such pedestal means is shown to include laterally spaced, upright pedestals 11 and 12, the lower ends of which are carried by a bottom yoke 13 attached to a base plate forward portion. The upper ends of the pedestals carry first and second coaxial bearing sleeves 14 and 15, which are laterally spaced apart. The pedestal means also carries third bearing structure 16, and specifically, an arm 17 extends laterally rightwardly from pedestal 12, and upwardly, to support structure 16. The latter includes a bearing housing 16*a*, and two roller bearing parts 16*b* and 16*c* positioned in housing 16*a*, in laterally spaced relation. Arm 17 is elbow-shaped and is integral with 12 and 16*a*. A primary axle or shaft 18 is carried by the first and third bearings, and specifically, by bearing sleeve 14 and bearing part 16*b*; and a secondary axle or shaft 19 is carried by the second and third bearings, and specifically, by the bearing sleeve 15 and bearing part 16*c*, the axles 18 and 19 being independently rotatable, yet coaxial.

A primary drum beater 21 is carried by the primary axle 18, and a secondary drum beater 22 is carried by the secondary axle 19, whereby the two beaters are separately operable. Note that the beater 21 has a shaft 21*a* and a connector 21*b* to axle 18; and beater 22 has a shaft 22*a* and a connector 22*b* to axle 19, both connectors laterally spaced, and located between the bearing sleeves 14 and 15 on the pedestals. See also the beater heads 21*c* and 22*c*. Axles 18 and 19 are polygonal to rigidly connect to the elements 21*b* and 22*b*.

A first pedal 31 is operatively connected to the primary axle 18 to rotate that axle and the primary beater 21 in response to pedal pivoting effected by the foot of the drummer.

In the FIG. 3 example, the pedal is pivoted at 33 to a heel support 34 attached to plate 10. Pivot 33 typically comprises roller bearing means, such as ball bearings, to reduce friction. A flexible coupling, such as chain 35, is connected at 36 to the forward end of the pedal, and extends upwardly to mesh with and wrap on sprocket 37. The latter is fixedly mounted on axle 18, whereby, as the pedal is pushed down, the sprocket and axle 18 are rotated, and the beater 21 rotates forwardly, so that head 21*c* strikes the drum surface indicated at 40. Yieldable means, such as tension spring 41 is operatively connected between the primary axle and the frame, such as the lower end of pedestal 11, to yieldably resist axle rotation, and return the beater to FIG. 3 position. Note that spring 41 has its upper end connected to crank 42 on shaft or axle 18.

A similar spring 46 is operatively connected between secondary axle 19 and the frame, such as the lower end of pedestal 12, to yieldably resist axle 19 rotation, to return secondary drum beater 22 to retracted position, as indicated in FIG. 3. That spring has its upper end connected to a crank 49 on shaft 19.

Axles 18 and 19 may have square cross sections to enable positive connection of the sleeve-type connectors 21*c* and 22*c* to the axles, set screws 21*d* and 22*d* also being provided. Annular bearings receive the axles for reception in the bearing sleeves 14 and 15.

The surface portions, including teeth 53 on the sprocket 37, may be located at progressively increasing radii from an axis 54 defined by axle 18, and located angularly about that axis, whereby those surface portions extend eccentrically relative to axis 54, as disclosed in U.S. Pat. No. 4,756,224. This causes the beater to travel progressively faster toward the drum surface, as the pedal is displaced downwardly at a fixed angular velocity.

The secondary axle 19 and secondary drum beater 22 may be rotatable by auxiliary means not mounted on plate 10. Such secondary means may, for example, include an elongated and elongatable rotary link 56 coupled to axle 19, as by coupling structure 57. The latter is shown to include universal joint members 58*a* and 58*b* rotatably interconnected by cross pin 58*c*. Member 58*a* is connected to the end 19*c* of axle 19 projecting away from the bearing 15; and member 58*b* is connected to a square cross section sub-shaft 59, as by transverse pin 60. Shaft 59 is also received in and connected to link member 56*a* via a coupling set screw 61, allowing extension of 56*a* and 59.

Figure 2:
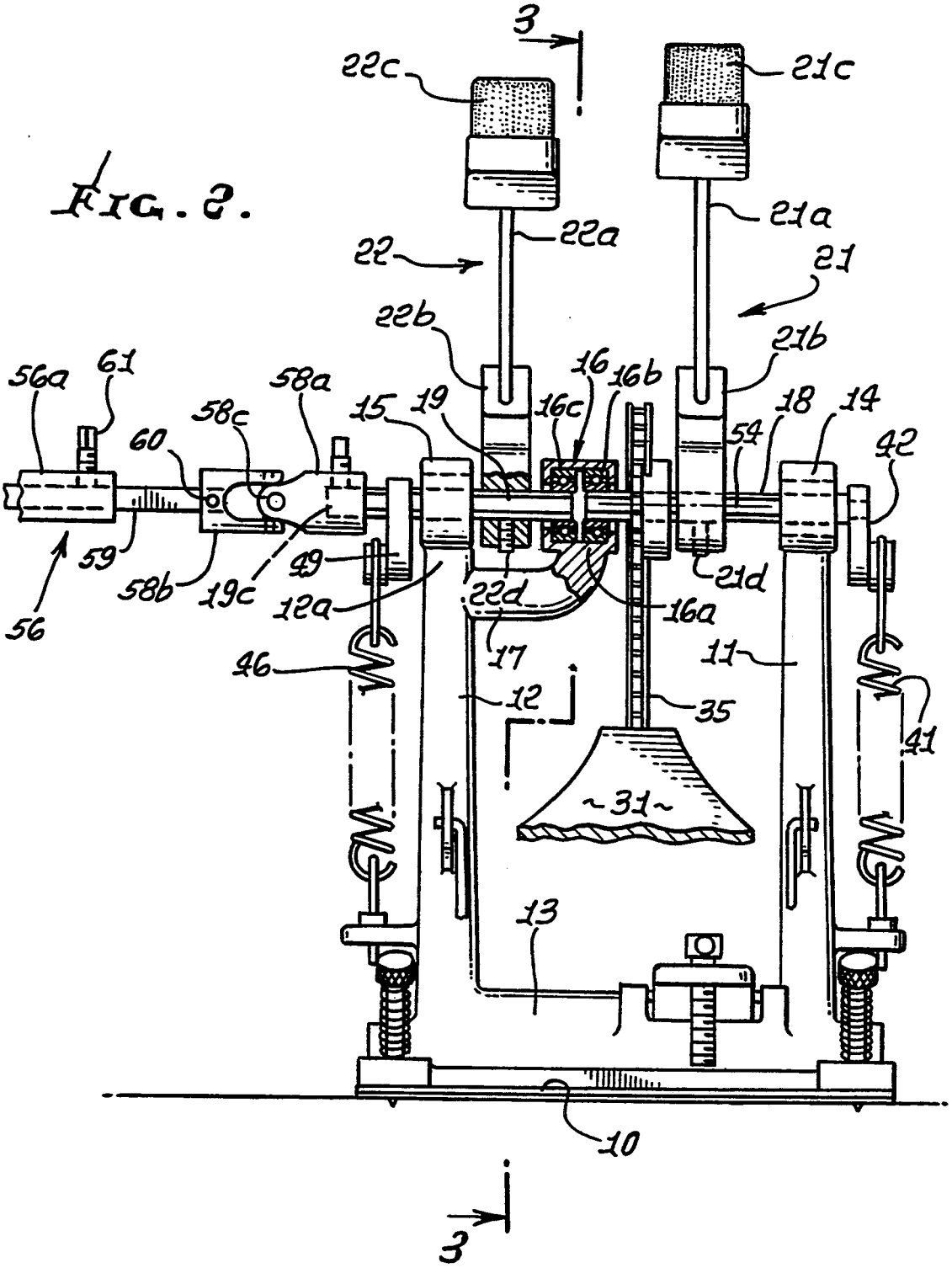
FIG. 2 is an enlarged section taken in elevation on lines 2—2 of FIG. 1.

Note that bearing 15 is coaxial with bearing 16, and carried by upper extension 12*a* of the pedestal. That upper extension 12*a* and arm 17 form a yoke, and between which beater 22 connector 22*b* is located. The two bearings 16*b* and 16*c* being separate may allow for some degree of axial mis-alignment of the axles 18 and 19, whereby each axle 18 and 19 is freely supported for rotation by only two bearings, yet the two beaters are located in close lateral relation, as seen in FIG. 2. Arm 17 is located above the pedal 31 so as not to interfere with it.

Figure 6:
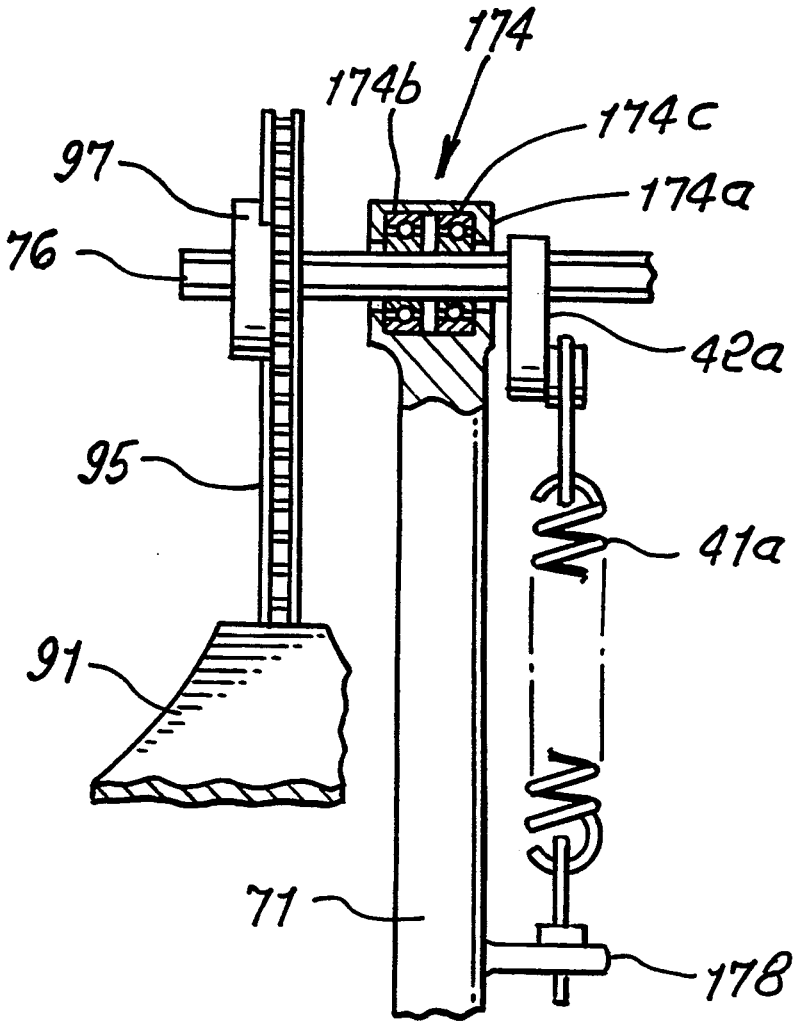
FIG. 6 is a fragmentary frontal view of the auxiliary pedal and single pedestal carrying the tertiary shaft.

FIGS. 1 and 6 show the provision of a second frame, including second pedestal means, such as single, upright pedestal 71. The latter is integrally mounted via bottom support 73*a* on a second base plate 73 which is independent of plate 10 and can be adjustably positioned at different locations relative to plate 10, to suit the drummer. See FIG. 5. Other bearing structure is carried by the second pedestal 71, and a tertiary axle or shaft 76 extends laterally and is shown as carried for rotation by the bearing 174. Link 56 is connected to tertiary axle 76 as by structure corresponding to structure 57. See for example universal joint 78, square cross section sub-shaft 79, and elongatable coupling 81. Set screws 82 and 61 are associated with the couplings 61 and 56 to adjustably grip the sub-shafts, allow complete disassembly or disconnection of the two axles 19 and 76, and the two base plates 10 and 73. Elongated link member 56*a* advantageously consists of lightweight metal, such as aluminum.

A pedal 91 is pivotally mounted at 93 on second base plate 73, and a flexible coupling, such as a chain 95, couples the forward end of the pedal 91 to a sprocket 97 attached to axle 76. Accordingly, the pedal 91 is coupled to the second beater 22 to rotate same, as pedal 91 is pushed downwardly. Plate or sprocket 97 may be eccentric, as described above, as respects sprocket 37. Holder members 102 and 103 also support the pedestals on the base plates, as shown.

As shown in FIG. 6, the bearing 174 includes a housing 174*a* and two roller bearing parts 174*b* and 174*c* positioned in housing 174*a*, in laterally spaced-apart relation. Single pedestal 71 supports bearing 174. A tension spring 41*a* and crank 42*a* are connected between the shaft 76 and lug 178 on the pedestal, to yieldably and resiliently return the shaft 76 and pedal 91, and beater 22, to initial rotary positions.

Accordingly, the invention provides a first pedal frame with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a first supporting shaft supported by the first and second bearing portions, the second shaft supporting the second beater being supported by the second and third bearing portions, whereby the second shaft is rotatable independently of the first shaft. There is also an additional shaft coupled to one of the first and second shafts, and a single pedestal on the second pedal frame and being the only pedestal supporting the additional shaft, saving weight and providing added space or room for other percussion equipment close to the drummer. A very simple adjustable pedal structure is thereby provided.

Adjustable clamp means 110 on the forward end of the plate 10 clamps to drum structure 40*a*, as shown.

Figure 7:
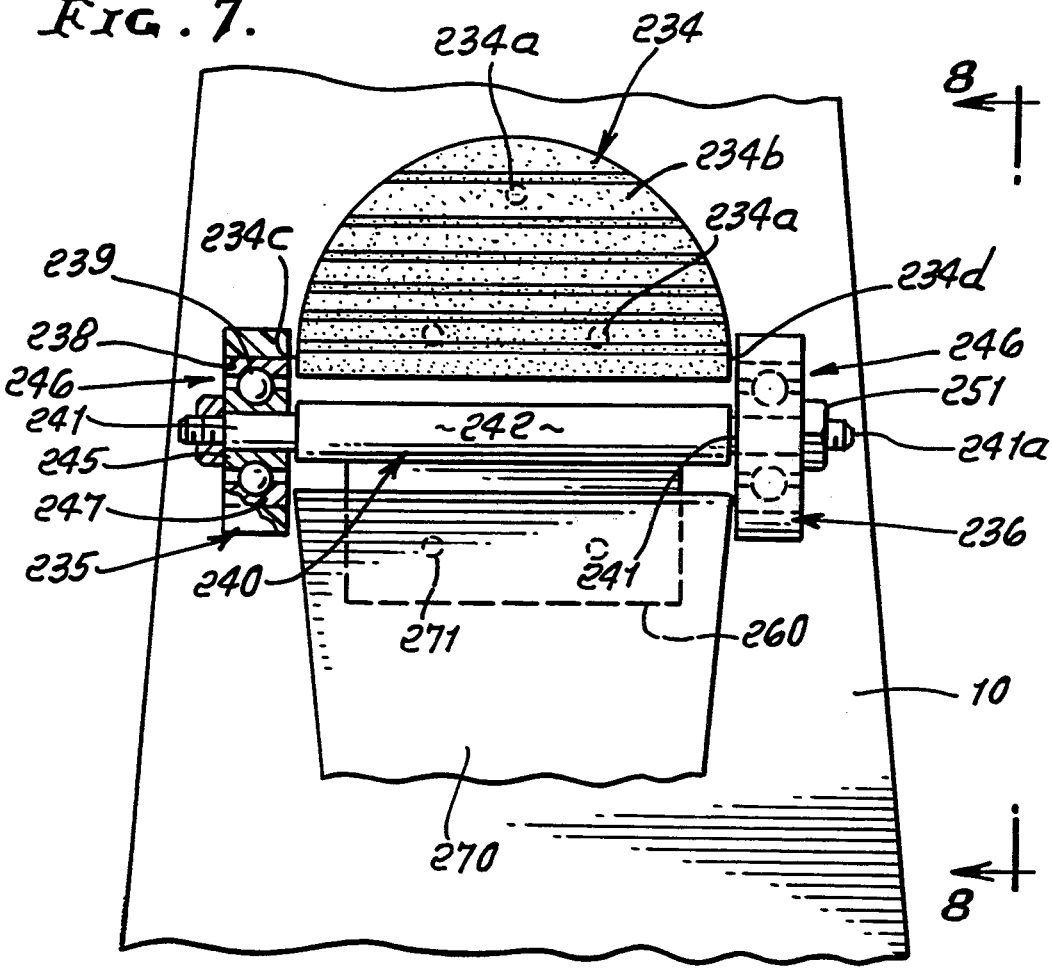
FIG. 7 is a top plan view of a pedal roller bearing support assembly.
Figure 8:
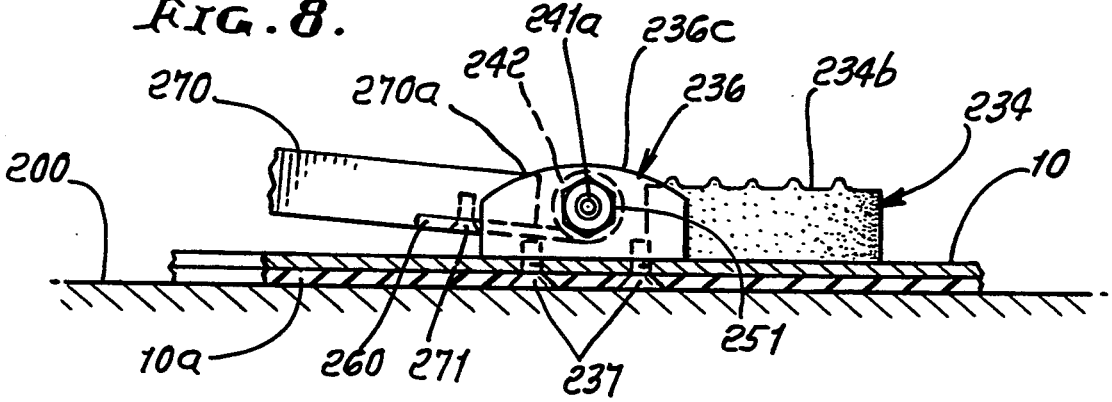
FIG. 8 is a side elevation taken on lines 8—8 of FIG. 7.

Referring now to FIGS. 7 and 8, a thin metal base plate 10 (typically metallic) has a rubber layer 10*a* attached to its underside to provide frictional resistance to sliding on floor surface 200. A heel support pad 234 is attached to the plate 10, as via fasteners, indicated by fastener openings 234*a*. The top 234*b* of the pad, typically consisting of hard rubber, is corrugated or roughened to support the drummer's shoe heel, without sliding.

Located at opposite lateral sides 234*c* and 234*d* of the pad 234 are two pillow blocks 235 and 236. They are alike, and may consist of molded plastic material. Fasteners 237 attach the blocks to the top surface of plate 10. Each block contains a laterally extending through opening 238, the latter being in lateral alignment. A roller bearing pivot support 240 is carried by the pillow blocks. The support 240 includes laterally elongated shaft means in the form of two trunnions 241 that project oppositely from a larger diameter shaft 242 extending laterally between the blocks. The trunnions may be integral with the shaft 242, and they project into the openings 238. Specifically, the trunnions are received and carried by inner races 245 of ball bearing units 246, the latter having outer races 247 carried by the annular bores forming the openings 238. Bearing balls appear at 239. Smaller diameter threaded extensions 241*a* of the trunnions project outwardly of the pillow blocks, for reception of nuts 251 that retain the trunnions endwise to the inner races. Thus, the horizontal shaft 242 has virtually friction free mounting to the plate 10.

A tab 260 is integral with the shaft 242 and projects forwardly therefrom, between and forwardly of the pillow blocks. Tab 260 is attached to the underside of the pedal 270, like pedal 31 or 91. See fasteners 271. Accordingly, the pedal has virtually friction free, rugged carriage by the base plate, proximate the heel pad 234; the top of the pedal is not being disturbed by connection to the shaft 242, and the top of the pad 234 not disturbed by such connection. Note that the uppermost surface of shaft 242 is approximately flush with the heel top 234*b*, and with the rearwardmost top surface 270*a* of the pedal. Also, the length of the shaft 242 is approximately equal to the heel plate width forwardly closest to the shaft, and to the width of the pedal at its rearwardmost extent. Thus, the shaft 242 provides additional support for the drummer's shoe heel.

Note also that the pillow block, has uppermost upwardly convex surfaces 236*c* at levels proximate the tops of the rearwardmost extent of said pedal and forwardmost extent of the heel plate. Accordingly interference with the drummer's shoe heel is minimized.

I claim:

1. In a drum beating assembly, the combination comprising a) a first frame including first pedestal means, b) first, second and third bearings carried by the first pedestal means, in spaced coaxial relation, c) a primary axle carried by the first and third bearings, and a primary drum beater carried by the said primary axle, d) a secondary axle carried by the second and third bearings, and a secondary drum beater carried by said secondary axle, e) said primary and secondary axles being independently rotatable, there being a first pedal operatively connected to the primary axle to rotate the primary axle and primary drum beater in response to pedal pivoting, f) and a first base plate integrally supporting said first pedestal means, the first plate also supporting the first pedal for pivoting relative thereto, g) there being auxiliary means operatively connected to the secondary axle to rotate the secondary axle and secondary drum beater, said auxiliary means including a tertiary axle and a single pedestal which is the only pedestal supporting the tertiary axle for rotation, and a second pedal operable to rotate the tertiary axle, h) and means supporting the single pedestal and said second pedal, i) a heel support on the first plate, and a roller bearing pivot support on the first plate supporting the first pedal for pivoting relative to the heel support and said first plate.

2. The combination of claim 1 including a primary rotor on the primary axle and a flexible coupling interconnecting the first pedal and primary rotor to rotate the rotor and primary axle when the pedal is pivotally displaced downwardly, and yieldable means operatively connected between the primary axle and first frame to yieldably resist pedal effected rotation of the primary axle, and also connected between the secondary axle and first frame to yieldably resist rotation of the secondary axle by said auxiliary means.

3. The combination of claim 1 wherein said third bearing includes two axially spaced bearing elements, a housing for said elements, and an armcarried by the first pedestal means and supporting the housing, the primary axle supported by one of said elements, and the secondary axle supported by the other of said elements.

4. The combination of claim 2 wherein the primary rotor has surface portions engaged by said coupling means, said surface portions located at progressively increasing radii from an axis defined by said primary axle, and angularly about said axis.

5. The combination of claim 3 wherein said surface portions extend eccentrically relative to said axis.

6. The combination of claim 1 including an elongated rotary link coupled to said secondary axle, and to said tertiary axle, said link consisting of relatively lightweight metal.

7. The combination of claim 6 wherein said metal consists of aluminum.

8. The combination of claim 1 including a second frame, a second pedal on the second frame, and roller bearing means carried by the second plate to support the second pedal for pivoting.

9. The combination of claim 1 including laterally spaced pillow blocks integral with the first plate, the roller bearing pivot support located between and carried by the pillow blocks.

10. The combination of claim 9 wherein the roller bearing pivot support includes laterally extending trunnion means supported by roller bearings in said pillow blocks, and structure carried by said bearings and attached to said pedal via a tab integral with the shaft means and projecting therefrom.

11. The combination of claim 1 including a bearing structure carried by the single pedestal and supporting said tertiary axle for rotation.

12. The combination of claim 11 wherein said bearing structure includes two axially spaced bearing elements, a housing for said elements, said single pedestal supporting the housing.

13. The combination of claim 12 including actuator spring means and a crank associated with said single pedestal and coupled to said tertiary axle, said return spring means and crank located at the side of said single pedestal closest to said first frame.

14. The combination of claim 1 including a primary rotor on the primary axle and a flexible coupling interconnecting the first pedal and primary rotor to rotate the primary rotor and primary axle when the first pedal is pivotally displaced downwardly; and yieldable means operatively connected between the primary axle and first frame to yieldably resist first pedal effected rotation of the primary axle, there being another rotor on the tertiary axle, and a flexible coupling interconnecting the other rotor and said second pedal.

15. The combination of claim 14 wherein said rotors have coupling engageable surfaces which are each eccentric relative to said primary and tertiary axles, respectively.

16. A double drum pedal apparatus in which a first pedal frame is provided with rotatable first and second beaters, and a first pedal for rotating said first beater when pushed down; a second pedal frame being provided with a second pedal; said second beater having a second supporting shaft operatively connected to said second pedal; and characterized in that said first pedal frame is provided with first, second and third bearing portions, the first beater having a first supporting shaft supported by said first and second bearing portions, said second shaft supporting the second beater being supported by said second and third bearing portions, whereby the second shaft is rotatable independently of the first shaft, there being an additional shaft coupled to one of said first and second shafts, and a single pedestal on the second pedal frame and supporting the entire additional shaft, and roller bearing pivot supports for said pedals.

17. In a drum beater assembly, the combination comprising a) first and second bases which are spaced apart, b) first shaft means and first pedestal means on the first base supporting the first shaft means for rotation, c) first and second beater means carried by the first shaft means, d) second shaft means and a single pedestal on the second base carrying the second shaft means for rotation, the second shaft means operatively connected to the first shaft means, e) pedals on the bases and operatively connected to the first and second shaft means, for rotating same, f) heel plates on the bases, g) and roller bearing pivot supports on the bases proximate said heel plates and supporting the pedals for pivoting.

18. The combination of claim 17 wherein the first shaft means includes a primary shaft carrying the first beater means and a secondary shaft carrying the second beater means, and rotatable independently of the primary shaft, the second shaft means operatively connected to only the primary shaft.

19. The combination of claim 18 including bearing structure carried by the single pedestal and supporting the second shaft means for rotation, said bearing structure includes two axially spaced bearing elements, a housing for said elements, said single pedestal mounting the housing.

20. The combination of claim 17 including roller bearings on the bases and supporting the pedals for rotation.

21. In a drum beater assembly, the combination comprising a) a first base, b) first shaft means and first pedestal means on the first base supporting the first shaft means for rotation, c) first beater means carried by the first shaft means, d) a pedal on the first base and operatively connected to the first shaft means, for rotating same, e) a heel plate on the first base, f) and a roller bearing pivot support on the base proximate said heel plate and supporting the pedal for pivoting forwardly of the heel plate, g) and laterally spaced pillow blocks integral with the first plate, the roller bearing pivot support located between and carried by the pillow blocks.

22. The combination of claim 21 including a second base spaced from the first base, second shaft means and a single pedestal on the second base carrying second shaft means for rotation, the second shaft means operatively connected to the first shaft means, a second pedal operatively connected to the second shaft means to rotate same, and a second roller bearing pivot support for the second pedal, on the second base.

23. The combination of claim 22 wherein the first shaft means includes a primary shaft carrying the first beater means and a secondary shaft carrying the second beater means, and rotatable independently of the primary shaft, the second shaft means operatively connected to only the primary shaft.

24. The combination of claim 21 wherein the roller bearing pivot support includes laterally extending trunnion means supported by roller bearings in said pillow blocks, and auxiliary shaft means carried by said trunnions and attached to said pedal via a tab integral with the auxiliary shaft means and projecting therefrom.

25. The combination of claim 24 wherein the auxiliary shaft means is positioned between the forwardmost extent of the heel plate and the rearwardmost extent of the pedal.

26. The combination of claim 25 wherein the auxiliary shaft means has top surface approximately flush with the tops or said rearwardmost extents of the heel plate and pedal.

27. The combination of claim 26 wherein the pillow blocks have upwardly convex surfaces at levels proximate said tops.

28. In a drum beater assembly, the combination comprising a) a platform, including a first base, b) first shaft means and first pedestal means on the first base supporting the first shaft means for rotation, c) first beater means carried by the first shaft means, d) a pedal on the first base and operatively connected to the first shaft means, for rotating same, e) the platform including a heel plate, f) and a rotary bearing pivot support carried on the platform proximate said heel plate and supporting the pedal for pivoting forwardly of the heel plate, g) and there being pillow block means carried by the platform and carrying said rotary bearing pivot support.

29. The combination of claim 28 including a second base spaced from the first base, second shaft means and a single pedestal on the second base carrying said second shaft means for rotation, the second shaft means operatively connected to the first shaft means, a second pedal operatively connected to the second shaft means to rotate same, and a second rotary bearing pivot support for the second pedal, and associated with the second base.

* * * * *